US010099504B2

(12) United States Patent
VanLeer et al.

(10) Patent No.: US 10,099,504 B2
(45) Date of Patent: Oct. 16, 2018

(54) FILE FOLDER HANGING RODS AND RELATED METHODS

(71) Applicant: RR Donnelley, Chicago, IL (US)

(72) Inventors: Mark D. VanLeer, Sullivan, MO (US); Ronald C. Thorpe, Union, MO (US)

(73) Assignee: LSC Communications US, LLC, Chicago, IL (US)

( * ) Notice: Subject to any disclaimer, the term of this patent is extended or adjusted under 35 U.S.C. 154(b) by 144 days.

(21) Appl. No.: 14/757,661

(22) Filed: Dec. 23, 2015

(65) Prior Publication Data

US 2017/0182833 A1 Jun. 29, 2017

(51) Int. Cl.
*B42F 15/00* (2006.01)
*B42F 13/00* (2006.01)
*B42F 21/00* (2006.01)

(52) U.S. Cl.
CPC ..... *B42F 15/0035* (2013.01); *B42F 15/0058* (2013.01)

(58) Field of Classification Search
CPC ..... B42F 15/0035; B42F 15/0058; B42F 15/094; B42F 21/065; B42F 21/08
See application file for complete search history.

(56) References Cited

U.S. PATENT DOCUMENTS 2,318,077 A * 5/1943 Jonas ..... B42F 15/0035 211/46
2,631,589 A * 3/1953 Zalkind ..... B42F 15/0035 211/126.13
2,678,651 A 5/1954 De Whalley
2,893,398 A * 7/1959 Jones ..... A61B 5/0215 211/126.13
2,910,985 A 11/1959 Epstein et al.
3,238,947 A 3/1966 Churnick
3,244,179 A 4/1966 Porteous et al.
3,255,758 A 6/1966 Gauche
3,957,321 A 5/1976 Rose
4,053,057 A 10/1977 Snowden
4,105,268 A 8/1978 Elias et al.
RE29,751 E 9/1978 Elias et al.
4,236,770 A * 12/1980 Moore ..... B42F 15/0035 299/67.2
4,294,028 A 10/1981 Remond
5,197,762 A 3/1993 Abramov
(Continued)

FOREIGN PATENT DOCUMENTS

DE 4218936 A1 * 12/1993 ..... B42F 15/0035
GB 2207638 2/1989
WO WO 2010135872 A1 * 12/2010 ..... B42F 15/0035

*Primary Examiner* — Kimberley S Wright
(74) *Attorney, Agent, or Firm* — Hanley, Flight & Zimmerman, LLC

(57) ABSTRACT

File folder hanging rods and related methods are disclosed. An example hanging rod to hang a file folder includes a first end, a second end opposite the first end, and outer flanges extending between the first end and the second end. The example hanging rod includes a middle portion between and protruding from the outer flanges. The middle portion has an M-shaped cross-section to increase a rigidity of the hanging rod. The example hanging rod includes a first notch adjacent the first end and a second notch adjacent the second end that enable the hanging rod to hang from the support structure.

17 Claims, 8 Drawing Sheets

(56) References Cited

U.S. PATENT DOCUMENTS

| | | | | |
|---|---|---|---|---|
| 5,328,259 | A | 7/1994 | Meriaux | |
| D356,830 | S | 3/1995 | Messier | |
| D382,301 | S | 8/1997 | Baumgarten | |
| 5,722,692 | A | 3/1998 | Abramov | |
| 5,873,513 | A * | 2/1999 | Ong | B42F 7/06 229/67.1 |
| 6,227,746 | B1 | 5/2001 | Long et al. | |
| 6,248,050 | B1 * | 6/2001 | Boy | B42C 7/001 383/22 |
| 6,273,470 | B1 * | 8/2001 | Bullock | B42F 7/02 229/67.1 |
| 7,059,483 | B2 | 6/2006 | Scudder | |
| D527,048 | S * | 8/2006 | Scudder | D19/32 |
| 7,100,775 | B2 | 9/2006 | Yeh | |
| D622,320 | S | 8/2010 | DeCarlo et al. | |
| 7,900,813 | B2 | 3/2011 | Dodson | |
| 7,954,694 | B2 | 6/2011 | DeCarlo et al. | |
| D688,302 | S | 8/2013 | Chung | |
| D689,548 | S | 9/2013 | Klosky | |
| 8,567,659 | B2 | 10/2013 | Chung | |
| 8,650,784 | B2 | 2/2014 | Halfen et al. | |
| D705,351 | S | 5/2014 | DeCarlo et al. | |
| D705,863 | S | 5/2014 | Klosky | |
| 8,746,539 | B2 | 6/2014 | Dodson | |
| D719,214 | S | 12/2014 | Klosky | |
| 9,156,303 | B2 | 10/2015 | DeCarlo et al. | |
| 9,573,408 | B2 * | 2/2017 | Goodfellow | B42F 15/0035 |
| 2002/0171343 | A1 * | 11/2002 | Miller | A47B 3/10 312/317.3 |
| 2005/0051506 | A1 * | 3/2005 | Scudder | B42F 15/0035 211/183 |
| 2009/0101605 | A1 * | 4/2009 | Goodfellow | B42F 15/0064 211/46 |
| 2009/0283577 | A1 | 11/2009 | Dodson | |
| 2014/0283659 | A1 | 9/2014 | Dodson | |
| 2016/0009121 | A1 | 1/2016 | DeCarlo et al. | |
| 2017/0120667 | A1 * | 5/2017 | Goodfellow | B42F 15/0064 |

* cited by examiner

FILE FOLDER HANGING RODS AND RELATED METHODS

FIELD OF THE DISCLOSURE

This patent relates generally to file folders and, more particularly, to file folder hanging rods and related methods.

BACKGROUND

File folders are used to store documents. File folders are often hung (e.g., in filing cabinets) to enable the file folders and the documents stored in the file folders to be conveniently organized and accessed. Some known file folders include hanging rods that extend along upper edges of the file folders. The hanging rods of such known file folders include hooks that extend from the file folders and receive a support structure (e.g., rails of a filing cabinet) to hang the file folder and its documents from the support structure.

BRIEF DESCRIPTION OF THE DRAWINGS

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or like parts.

DETAILED DESCRIPTION

Figure 1:
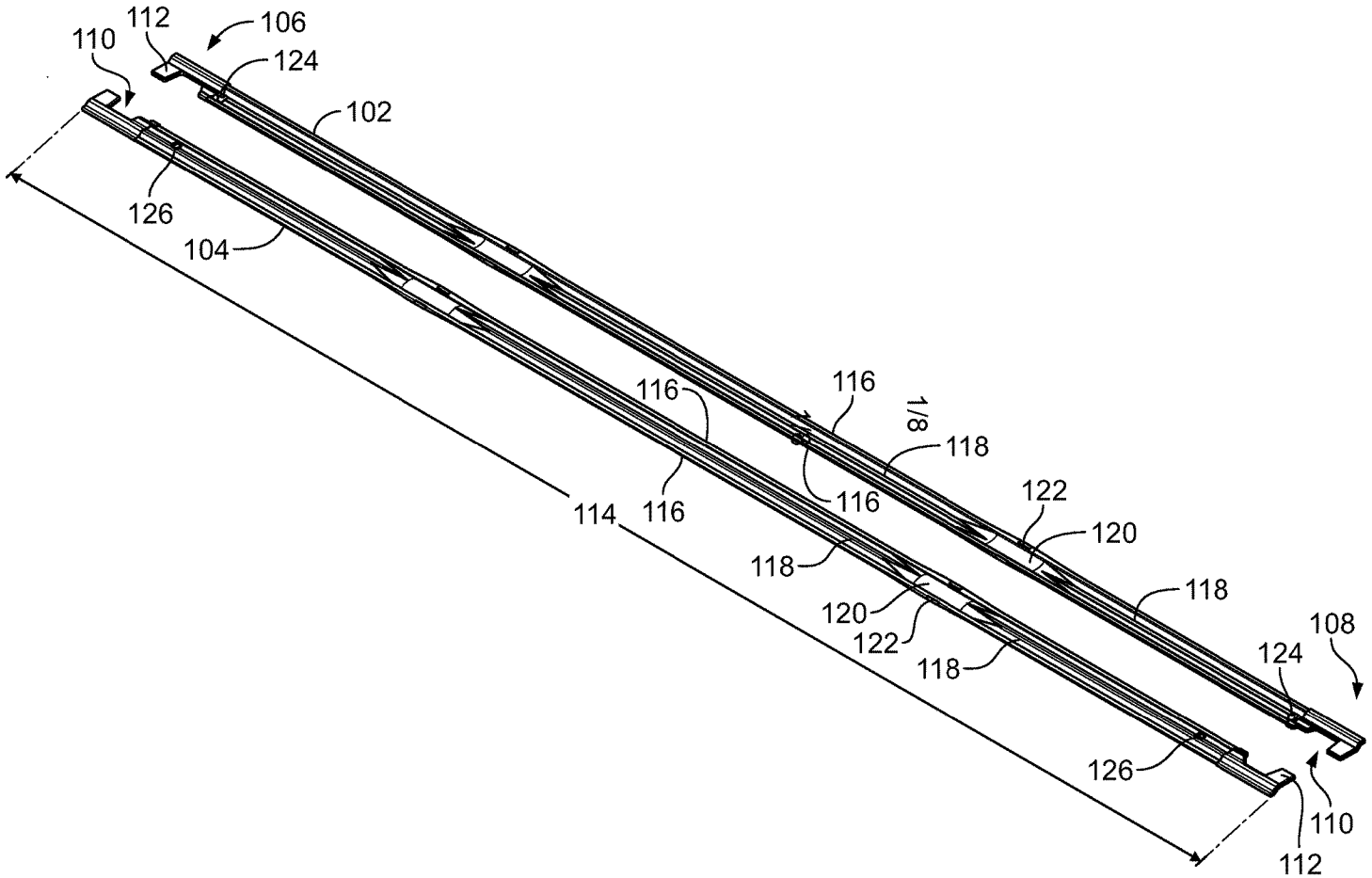
FIG. 1 is a front perspective view and a rear perspective view of example hanging rods in accordance with the teachings of this disclosure.

File folders are often employed to store documents. Generally, the file folders are composed of cardstock, heavyweight paper, plastic and/or composite material. In some examples, the file folders include a first panel and a second panel that are hingedly coupled together via a fold line. The file folders may store materials (e.g., documents, pieces of paper, pads of paper, brochures, booklets, etc.) by receiving and/or containing the materials between the first panel and the second panel.

Hanging file folders are file folders that are capable of hanging from a support structure. For example, hanging file folders may be hung within filing cabinets (e.g., via rails of filing cabinets) to enable the file folders and, thus, the materials stored within the file folders to be conveniently organized and accessed. In some examples, the hanging file folders include hooks that extend beyond the panels of the file folder. The hooks are to receive a support structure (e.g., rails of a filing cabinet) to enable the file folder to hang from the support structure.

In some examples, hanging file folders include hanging rods that have the hooks from which the file folders hang. For example, to enable a file folder to hang from a support structure, one hanging rod is coupled to an outer edge of the first panel and another hanging rod is coupled to an opposing outer edge of the second panel. Some file folders include outer edges that define apertures through which the hanging rods extend to couple to the respective outer edges of the panels. In such examples, the hooks of the hanging rods extend beyond the apertures defined by the edges of the file folder panels, thereby enabling the hooks to receive the support structure to hang the file folder from the support structure.

Thus, the hanging rods are supported by the support structure, and the panels of such file folders hang from the hanging rods supported by the support structure. As a result, the hanging rods of file folders are to support a weight of the file folder and any materials stored within the file folder. For example, a first hanging rod coupled to a first panel and a second hanging rod coupled to a second panel is designed to withstand the combined weight of the file folder and the materials stored within the file folder. In some instances, a file folder hanging from a support structure via hanging rods contains a large amount of material (e.g., a file wrapper of a patent granted by United States Patent and Trademark Office) that weighs a significant amount. Accordingly, the hanging rods of file folders are designed to support a relatively significant amount of weight without buckling, breaking and/or otherwise failing so that the file folder does not fall from the support structure from which it is hung.

To prevent file folders from failing due to the weight of the file folder and the materials stored within the file folder, some file folders include hanging rods having an increased thickness (e.g., a lower gauge of sheet stock of material) to increase a strength and/or rigidity of the hanging rods. However, increasing the thickness of hanging rods significantly increases an amount of material used to form the hanging rods and, thus, significantly increases the weight of and the cost to produce the hanging rods.

Example hanging rods disclosed herein include a cross-section that increases a strength and/or rigidity of the hanging rods to enable the hanging rods to support an increased amount of weight from file folders and/or materials stored in the file folders. Further, the cross-section of the example hanging rods having the increased strength and/or rigidity enables an amount of material used to manufacture the example hanging rods to be reduced to reduce manufacturing costs associated with raw materials.

In some examples, the hanging rod disclosed herein includes a first notch (e.g., a groove, a hook, an indentation, a slot, etc.) adjacent a first end and a second notch (e.g., a groove, a hook, an indentation, a slot, etc.) adjacent a second end opposite the first end. The first and second notches are to receive a support structure to enable the hanging rod to hang from and/or be supported by the support structure. The hanging rod includes outer flanges that extend between the first end and the second end and a middle portion that protrudes between the outer flanges. The middle portion has an M-shaped or W-shaped cross-section (depending on an orientation of the hanging rod) that increases a rigidity and/or strength of the hanging rod. In some examples, the hanging rod includes an intermediate portion having an arc-shaped cross section that is positioned between the outer flanges and adjacent the middle portion. The intermediate portion and the outer flanges form a width large enough to enable the hanging rod to be maneuvered by equipment during a manufacturing process of the hanger rod and/or an assembly process of a corresponding file folder. In some examples, the middle portion of the hanging rod defines a dimple that extends beyond the M-shaped or W-shaped cross-section to prevent the hanging rod from nesting with another hanging rod (e.g., during the manufacturing and/or assembly processes). The dimple of the hanging rod is offset from a dimple of the other hanging rod to prevent the hanging rods from nesting together when stacked.

Example hanging rods disclosed herein include a first end, a second end opposite the first end, and outer flanges extending between the first end and the second end. The example hanging rods include a middle portion between and protruding from the outer flanges. The middle portion has an M-shaped cross-section to increase a rigidity of the hanging rod. The example hanging rods include a first notch adjacent the first end and a second notch adjacent the second end that enable the hanging rod to hang from the support structure.

In some examples, a nadir of the M-shaped cross-section of the middle portion extends toward and is spaced apart from a plane along which the outer flanges extend.

Some example hanging rods include an intermediate portion between the outer flanges and adjacent the middle portion. The intermediate portion has an arc-shaped cross-section. In some such examples, the intermediate portion and the outer flanges define a first width of the hanging rod that is greater than a second width of the hanging rod defined by the middle portion and the outer flanges. In some such examples, the middle portion and the intermediate portion alternate along a length of the hanging rod between the first end and the second end.

In some examples, the middle portion defines a first dimple to prevent the hanging rod from nesting with a second hanging rod. In some such examples, the first dimple extends beyond the M-shaped cross-section of the middle portion and to a plane along which the outer flanges extend. In some such examples, the first dimple is offset relative a second dimple of the second hanging rod to further prevent the hanging rod from nesting with the second hanging rod. In some such examples, the middle portion of the hanging rod defines a third dimple spaced apart from the first dimple. The third dimple is offset relative a fourth dimple of the second hanging rod to further prevent the hanging rod from nesting with the second hanging rod.

Some example hanging rods include a first extension having a flat surface and protruding between the first notch and the first end. The first extension defines a portion of the first notch. Such example hanging rods include a second extension having a flat surface and protruding between the second notch and the second end. The second extension defines a portion of the second notch.

Some example hanging rods include a first extension protruding between the first end and the first notch. The middle portion of the hanging rod extends along the first extension such that the M-shaped cross-section defines a portion of the first notch. Such example hanging rods include a second extension protruding between the second end and the second notch. The middle portion extends along the second extension such that the M-shaped cross-section defines a portion of the second notch.

Some example hanging rods include a coating adjacent the first end and the second end to enable the hanging rod to slide along the support structure.

Example methods disclosed herein include forming holes in sheet stock adjacent edges of the sheet stock to form notches defined by a first hanging rod and a second hanging rod. The notches are to enable the first hanging rod and the second hanging rod to hang from a support structure. The example methods include cutting the sheet stock to define outer edges of the first hanging rod and the second hanging rod. The example methods include stamping the sheet stock to form a first middle portion between first outer flanges of the first hanging rod. The first middle portion has an M-shaped cross-section to increase a rigidity of the first hanging rod. The example methods include stamping the sheet stock to form a second middle portion between second outer flanges of the second hanging rod. The second middle portion has an M-shaped cross-section to increase a rigidity of the second hanging rod. The example methods include separating the first hanging rod and the second hanging rod.

In some examples, stamping the sheet stock further includes concurrently forming the M-shaped cross-section of the first hanging rod and the M-shaped cross-section of the second hanging rod.

In some examples, stamping the sheet stock further includes forming the M-shaped cross-section of the first hanging rod in a first orientation and forming the M-shaped cross-section of the second hanging rod in a second orientation opposite the first orientation.

In some examples, stamping the sheet stock further includes forming a first dimple in the first middle portion of the first hanging rod and forming a second dimple in the second middle portion of the second hanging rod, the first dimple and the second dimple being offset.

In some examples, stamping the sheet stock further includes forming a first intermediate portion adjacent the first middle portion of the first hanging rod and forming a second intermediate portion adjacent the second middle portion of the second hanging rod. The first intermediate portion and the second intermediate portion have arc-shaped cross-sections.

In some examples, stamping the sheet stock further includes forming the M-shaped cross-section of the middle portion along a length of the first hanging rod and along a length of the second hanging rod.

In some examples, forming holes in the sheet stock adjacent the edges of the sheet stock to form the notches of the first hanging rod and the second hanging rod includes forming a first set of holes adjacent the edges of the sheet stock and forming a second set of holes over the first set of holes. The second set of holes has different perimeters than perimeters of the first set of holes. The perimeters of the second set of holes define the notches of the first hanging rod and the second hanging rod.

In some examples, cutting the sheet stock further includes defining a tab that connects the first hanging rod and the second hanging rod, and separating the first hanging rod and the second hanging rod includes severing the tab.

FIG. 1 illustrates example hanging rods 102, 104 in accordance with the teachings of this disclosure. As illustrated in FIG. 1, the hanging rods 102, 104 include a first end 106 and a second end 108 opposite the first end 106. The example hanging rods 102, 104 are composed of a metal (e.g., steel, aluminum, etc.), a plastic, a composite and/or any other material or combination of materials that are able to support a file folder hanging from the hanging rods 102, 104.

As illustrated in FIG. 1, the hanging rods 102, 104 include notches 110 (e.g., hooks, indentations, slots, etc.) adjacent the first end 106 and the second end 108 of the respective hanging rods 102, 104. For example, the hanging rod 102 defines one of the notches 110 adjacent the first end 106 and another of the notches 110 adjacent the second end 108. Similarly, the hanging rod 104 defines one of the notches 110 adjacent the first end 106 and another of the notches 110 adjacent the second end 108. The notches 110 are to receive a support structure (e.g., rails of a filing cabinet) to enable the hanging rods 102, 104 of the illustrated example to hang a file folder from the support structure. As illustrated in FIG. 1, a coating 112 covers the notches 110 adjacent the respective ends 106, 108 of the hanging rods 102, 104 to enable the hanging rods 102, 104 to slide along the support structure. The coating 112 may be a powder coating in examples in which the hanging rods 102, 104 are composed of steel or another metallic material.

To enable the hanging rods 102, 104 to hang a file folder from a support structure, one of the hanging rods 102, 104 is coupled to an outer edge of a first panel of the file folder and another of the hanging rods 102, 104 is coupled to an opposing outer edge of a second panel of the file folder. In some examples, the hanging rods 102, 104 extend through apertures defined by the respective edges to couple to the hanging rods 102, 104 to the edges. The hanging rods 102, 104 of the illustrated example have a length 114 that is defined by the distance the first end 106 and the second end 108. The length 114 of the hanging rods 102, 104 is greater than a width of the corresponding file folder panels such that the notches 110 of the hanging rods 102, 104 extend beyond the file folder panels, thereby enabling the notches 110 to receive and hang from the support structure. In the illustrated example, the length 114 of the hanging rods 102, 104 is about 12.75 inches for letter-size file folders. In other examples, the length 114 of the hanging rods 102, 104 may be longer or shorter depending on a width of the corresponding file folder or other desired use. For example, the length 114 of the hanging rods 102, 104 for legal-size file folders is about 15.75 inches.

As illustrated in FIG. 1, outer flanges 116 extend along the length 114 of the respective hanging rods 102, 104 between the first end 106 and the second end 108. A middle portion 118 is positioned between and protrudes from the outer flanges 116 of the respective hanging rods 102, 104. For example, the hanging rod 102 includes two of the outer flanges 116 extending between the first end 106 and the second end 108 and the middle portion 118 protruding between the two opposing outer flanges 116. Similarly, the hanging rod 104 includes two of the outer flanges 116 extending between the first end 106 and the second end 108 and the middle portion 118 protruding between the two opposing outer flanges 116. The middle portions 118 of the example hanging rods 102, 104 have an M-shaped cross-section or a W-shaped cross-section depending on the orientation of the hanging rods 102, 104. In the illustrated example of FIG. 1, the hanging rods 102, 104 are oriented in opposing directions such that the middle portion 118 of the hanging rod 102 has a W-shaped cross-section and the middle portion 118 of the hanging rod 104 has an M-shaped cross-section.

The example hanging rods 102, 104 include intermediate portions 120 that protrude between the outer flanges 116 and are adjacent the middle portions 118. In the illustrated example, the intermediate portions 120 have arc-shaped cross-sections and protrude from the outer flanges 116 in a same direction as the adjacent middle portions 118. For example, the middle portion 118 and the intermediate portion 120 of the hanging rod 102 protrude from the outer flanges 116 in a downward direction in FIG. 1, and the middle portion 118 and the intermediate portion 120 of the hanging rod 104 protrude from the outer flanges 116 in an upward direction in FIG. 1. The middle portion 118 and the intermediate portion 120 of the example hanging rods 102, 104 alternate along the length 114 of the hanging rods 102, 104.

As illustrated in FIG. 1, the hanging rods 102, 104 include tabs 122 that are adjacent the intermediate portions 120 along the opposing outer flanges 116 of the hanging rods 102, 104. As described in further detail below in connection with FIGS. 10 and 11, the tabs 122 temporarily keep the hanging rods 102, 104 integrally coupled together during a manufacturing process of the hanging rods 102, 104 to enable the characteristics of the hanging rods 102, 104 (e.g., the middle portion 118, the intermediate portion 120, dimples 124, 126) to be formed from sheet stock (e.g., sheet stock 1102 of FIG. 11).

Further, the hanging rods 102, 104 of the illustrated example include the respective dimples 124, 126. For example, the middle portion 118 of the hanging rod 102 defines one of the dimples 124 (e.g., a first dimple, a first dimple of the hanging rod 102) adjacent the first end 106 and another of the dimples 124 (e.g., a third dimple, a second dimple of the hanging rod 102) adjacent the opposing second end 108. Similarly, the middle portion 118 of the hanging rod 104 defines one of the dimples 126 (e.g., a second dimple, a first dimple of the hanging rod 104) adjacent the first end 106 and another of the dimples 126 (e.g., a fourth dimple, a second dimple of the hanging rod 104) adjacent the opposing second end 108. As described in further detail below in connection with FIGS. 6 and 7, the offset dimples 124, 126 of the respective hanging rods 102, 104 prevent the hanging rods 102, 104 from nesting together when stacked (e.g., during a manufacturing process of the hanging rods 102, 104, during an assembly process of a corresponding hanging file folder, etc.).

Figure 2:
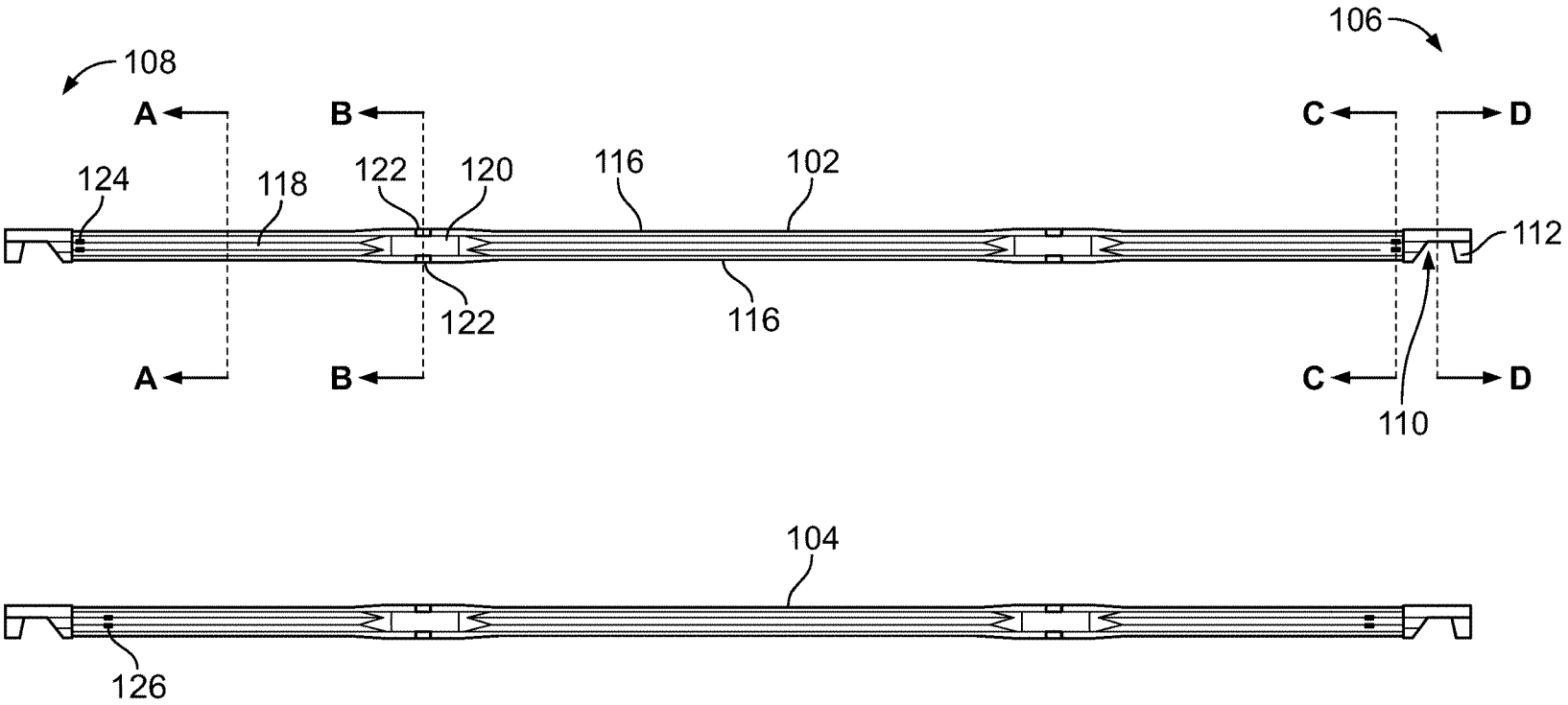
FIG. 2 is a top view of the example hanging rods of FIG. 1.

FIG. 2 is a top view of the example hanging rods 102, 104. For example, FIG. 2 illustrates the first end 106, the second end 108, the notches 110, the coating 112, the outer flanges 116, the middle portion 118, the intermediate portion 120, the tabs 122, and the dimples 124, 126 of the respective hanging rods 102, 104. In FIG. 2, the hanging rods 102, 104 are oriented such that the middle portion 118 of both of the hanging rods 102, 104 has an M-shaped cross-section and the intermediate portion 120 of both of the hanging rods 102, 104 protrudes in an upward direction from the outer flanges 116.

Figure 3:
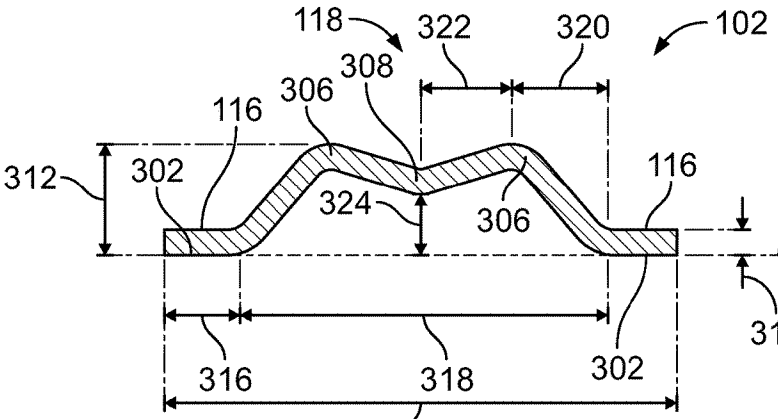
FIG. 3 is a cross-sectional view of one of the example hanging rods of FIGS. 1-2 taken along line A-A of FIG. 2.

FIG. 3 is a cross-sectional view of the example hanging rod 102 taken along line A-A of FIG. 2. More specifically, FIG. 3 is a cross-sectional view of the outer flanges 116 and the middle portion 118 of the example hanging rod 102.

In the illustrated example, the outer flanges 116 are flat and are even with each other such that a surface 302 of the outer flanges 116 extend along a plane 304. The middle portion 118 of the example hanging rod 102 protrudes from the plane 304 between the outer flanges 116. In the illustrated example, the hanging rod 102 is oriented such that the middle portion 118 has an approximately M-shaped cross-section. The M-shaped cross-section of the middle portion 118 defines two upper bumps 306 and a nadir 308 extending between the upper bumps 306. For example, the middle portion 118 is bent and/or curled upward from each of the outer flanges 116 to a respective one of the upper bumps 306, and the middle portion 118 is bent and/or curled downward from each of the upper bumps 306 to the nadir 308. The M-shaped cross-section of middle portion 118 increases a strength and/or rigidity of the hanging rod 102 and, thus, increases an amount of weight that the hanging rod 102 is able to support (e.g., weight of a file folder hanging from the hanging rod 102, weight of materials stored in the file folder hanging from the hanging rod 102, etc.) while reducing and/or without increasing a thickness 310 of the hanging rod 102.

In other examples, the hanging rod 102 may be oriented in an opposite direction such that the middle portion 118 has a W-shaped cross-section. In such examples, the cross-section of the middle portion 118 defines two lower bumps and an apex extending between the two lower bumps. In such examples, the middle portion 118 is bent and/or curled downward from each of the outer flanges 116 to a respective one of the lower bumps 306, and the middle portion 118 is bent and/or curled upward from each of the upper bumps to the apex. Alternatively, the hanging rod 102 may be rotated such that the middle portion 118 has, for example, an E-shaped cross-section or a 3-shaped cross-section.

The thickness 310 of the example hanging rod 102 is about 0.012 inches. As illustrated in FIG. 3, the hanging has a height 312 of about 0.052 inches that extends from the plane 304 and/or the surface 302 of the outer flanges 116 to the upper bumps 306 of the middle portion 118. As illustrated in FIG. 3, the cross-section of the hanging rod 102 has a width 314 of about 0.245 inches. Each of the outer flanges 116 has a width 316 of about 0.031 inches, and the middle portion 118 has a width 318 of about 0.183 inches. As illustrated in FIG. 3, the M-shaped cross-section of the example middle portion 118 includes a width 320 defined between one of the upper bumps 306 and the adjacent outer flange 116 and a width 322 defined between one of the upper bumps 306 and the nadir 308. For example, the width 320 is about 0.048 inches and the width 322 is about 0.044 inches. Further, while the nadir 308 of the example M-shaped cross-section protrudes toward the plane 302, the nadir 308 does not extend to the plane 304 such that a height 324 (e.g., about 0.029 inches) separates the nadir 308 from the plane 304. The widths 314, 316, 318, 320, 322; the heights 312, 324; the thickness 310; and/or any other features of the cross-section of the middle portion 118 are not limited to any particular example dimensions provided above and may vary based on the particular application of the hanging rod 102. For example, the width 316 of one of the outer flanges 116 may be different than the width 316 of the opposing outer flange 116.

Figure 4:
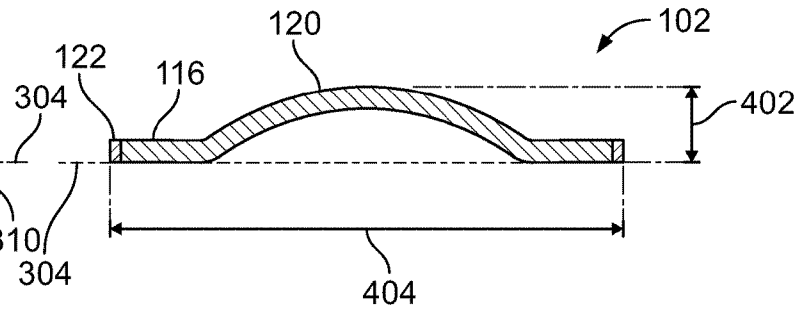
FIG. 4 is a cross-sectional view of one of the example hanging rods of FIGS. 1-2 taken along line B-B of FIG. 2.

FIG. 4 is a cross-sectional view of the example hanging rod 102 taken along line B-B of FIG. 2. More specifically, FIG. 4 is a cross-sectional view of the intermediate portion 120, the outer flanges 116, and the tabs 122 of the example hanging rod 102. As illustrated in FIG. 4, the intermediate portion 120 extends between the outer flanges 116, and the tabs 122 are adjacent the outer flanges 116. For example, the intermediate portion 120 protrudes away from the plane 304 defined by the outer flanges 116.

In the illustrated example, the cross-section of the hanging rod 102 has a height 402 of about 0.041 inches and a width 404 of about 0.271 inches. Thus, the height 402 of the cross-section that includes the intermediate portion 120 (FIG. 4) is less than the height 312 of the cross-section that includes the middle portion 118 (FIG. 3), and the width 404 of the cross-section that includes the intermediate portion 120 (FIG. 4) is greater than the width 314 of the cross-section that includes the middle portion 118 (FIG. 3). The increased width 404 of the hanging rod 102 at the intermediate portion 120 enables the example hanging rod 102 to be maneuvered by equipment during a manufacturing process of the hanging rod 102 and/or assembly process of a corresponding file folder. For example, if the width 404 of the illustrated example is reduced significantly, the processing and/or manufacturing equipment may cause the tabs 122 to stretch to a point of breaking. As a result, the adjacent hanging rods 102, 104 may uncouple prematurely before other processing and/or manufacturing processes are completed.

Figure 5:
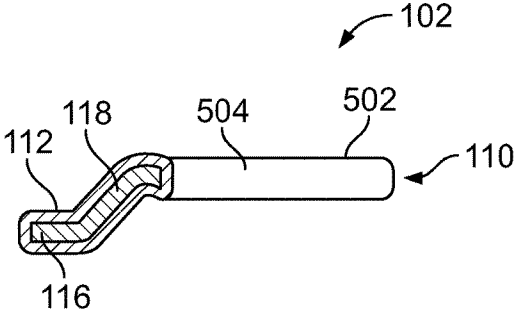
FIG. 5 is a cross-sectional view of one of the example hanging rods of FIGS. 1-2 taken along line C-C of FIG. 2.

FIG. 5 is a cross-sectional view of the example hanging rod 102 taken along line C-C of FIG. 2. More specifically, FIG. 5 is a cross-sectional view of the notch 110 (e.g., a first notch) adjacent the first end 106 (FIGS. 1-2) of the example hanging rod 102.

As illustrated in FIG. 5, the coating 112 covers the outer flange 116 and the middle portion 118 of the hanging rod 102 that is adjacent the notch 110. In the illustrated example, an extension 502 (e.g., a first extension) protrudes from the middle portion 118 to define a portion 504 of the notch 110. For example, the extension 502 extends between the notch 110 and the adjacent first end 106 (FIGS. 1-2). The extension 502 of the illustrated example is flat such that the portion 504 of the notch 110 defined by the extension 502 extends in a straight line. Further, while FIG. 5 illustrates features and/or dimensions of the notch 110 (e.g., the first notch) and the extension 502 (e.g., the first extension) adjacent the first end 106, features and/or dimensions of the notch 110 (e.g., a second notch) and the extension 502 (e.g., a second extension) adjacent the second end 108 (FIGS. 1-2) may be substantially similar to that of FIG. 5.

Figure 6:
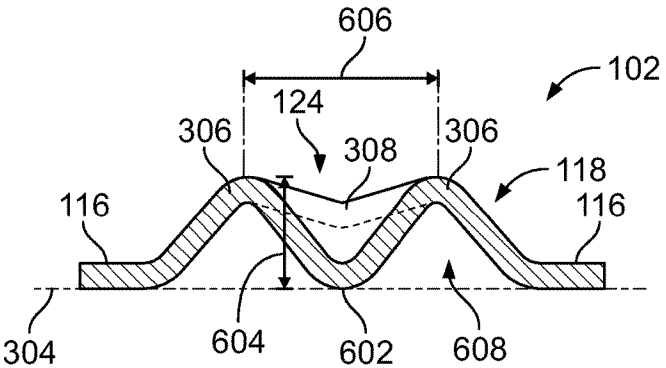
FIG. 6 is a cross-sectional view of one of the example hanging rods of FIGS. 1-2 taken along line D-D of FIG. 2.

FIG. 6 is a cross-sectional view of the example hanging rod 102 taken along line D-D of FIG. 2. More specifically, FIG. 6 is a cross-sectional view of the outer flanges 116, the middle portion 118, and the dimple 124 adjacent the first end 106 (FIGS. 1-2) of the example hanging rod 102.

As illustrated in FIG. 6, when the hanging rod 102 is oriented such that the middle portion 118 has an M-shaped cross-section, the example dimple 124 includes a nadir 602 that protrudes downward from the upper bumps 306 of the middle portion 118. In the illustrated example, the nadir 602 extends to the plane 304 defined by the outer flanges 116 of the hanging rod 102 such that the dimple 124 has a height 604 that is substantially equal to the height 312 (FIG. 3) of the hanging rod 102. For example, the height 604 of the dimple 124 is about 0.052 inches though other dimensions may be used. Further, the dimple 124 of the illustrated example has a width 606 that is defined by the opposing upper bumps 306 of the middle portion 118. For example, the width 606 of the dimple 124 is about 0.087 inches though other dimensions may be used. In examples in which the hanging rod 102 is oriented such that the middle portion 118 has a W-shaped cross-section, the dimple 124 includes an apex that protrudes upward from lower bumps of the middle portion 118.

In the illustrated example, the nadir 602 of the dimple 124 protrudes into a cavity 608 defined by the middle portion 118. For example, the nadir 602 of the dimple 124 extends to the plane 304 beyond the nadir of the middle portion 308. The dimple 124 protrudes into the cavity 608 to prevent another hanging rod (e.g., the hanging rod 104 of FIGS. 1 and 2) from nesting and/or fitting compactly within the cavity 608 of the hanging rod 102 when stacked. For example, the dimple 124 of the hanging rod 102 is to contact a middle portion of the other hanging rod to prevent the middle portion of the other hanging rod from resting flush with the middle portion 118 within the cavity 608.

Further, while FIG. 6 illustrates features and/or dimensions of the dimple 124 adjacent the first end 106, a cross-section of the dimple 124 adjacent the second end 108 (FIGS. 1 and 2) may be substantially similar to that of FIG. 6 to further prevent another hanging rod from nesting within the cavity 608 of the hanging rod 102.

Moreover, the features and/or dimensions of the hanging rod 104 of FIGS. 1 and 2 may be identical and/or substantially similar to those of the hanging rod 102 as identified in FIGS. 3-6. For example, the features and/or dimensions of the outer flanges 116, the middle portion 118, the intermediate portion 120, and the dimples 126 of the hanging rod 104 are similar to the features and/or dimensions of the outer flanges 116, the middle portion 118, the intermediate portion 120, and the dimples 124 of the hanging rod 102 illustrated in FIGS. 3-6. Though, as described below, there may be different placement of the dimples 124, 126 relative to the ends 106, 108 and/or the notches 110.

Figure 7:
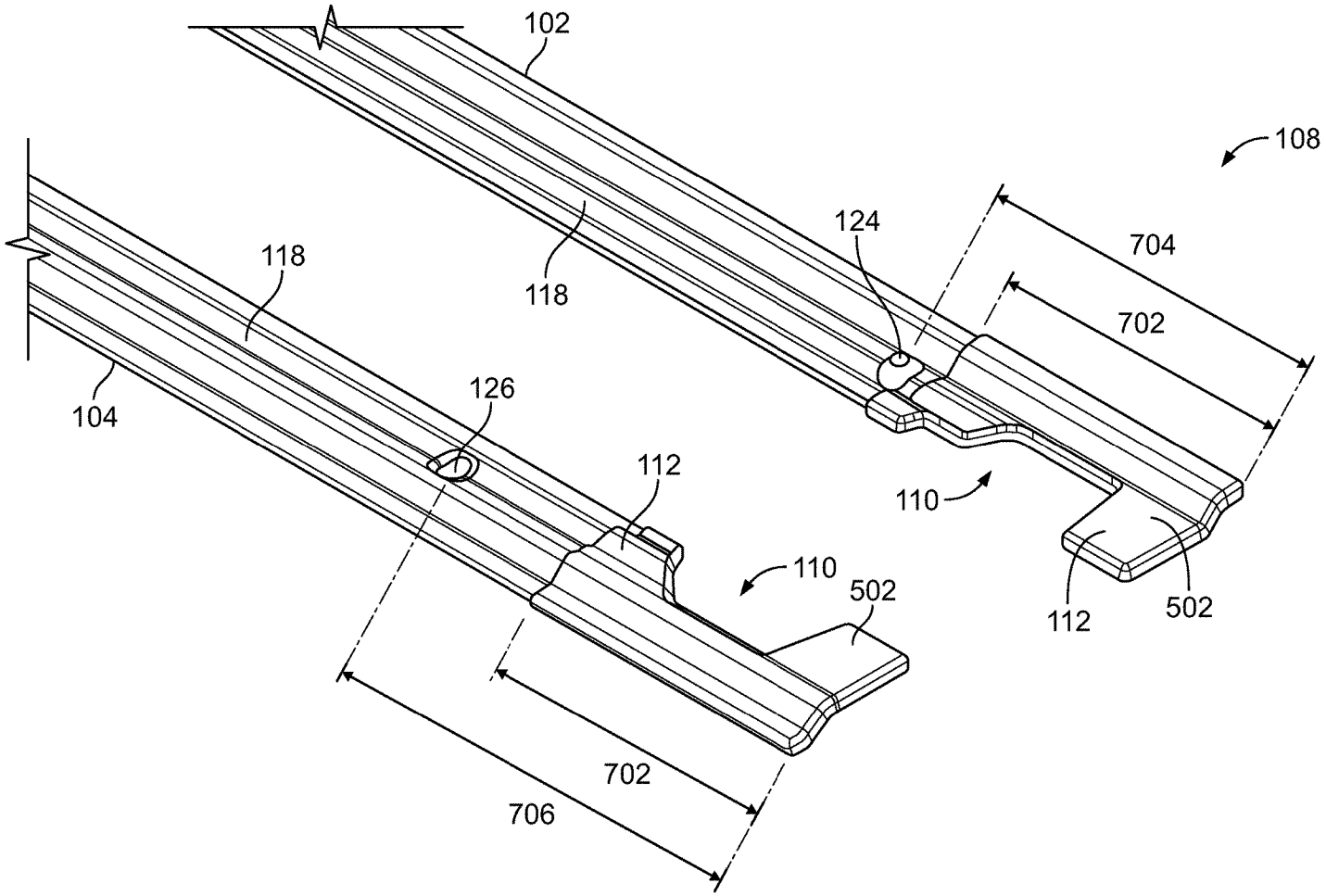
FIG. 7 is an enlarged view of one of the ends of the example hanging rods of FIG. 1.

FIG. 7 is a close-up perspective view of the second end 108 of the example hanging rods 102, 104. In the illustrated example, the hanging rods 102, 104 are oriented in different directions. For example, the hanging rod 102 is oriented in FIG. 7 such that the middle portion 118 of the hanging rod 102 has a W-shaped cross-section, and the hanging rod 104 is oriented in FIG. 7 such that the middle portion 118 of the hanging rod 104 has an M-shaped cross-section.

In the illustrated example, the coating 112 extends a length 702 along the respective hanging rods 102, 104 from the second end 108. In the illustrated example, the length 702 of the coating 112 of the respective hanging rods 102, 104 is about between 0.562 inches and 0.812 inches, though other dimensions may be used. For example, the coating 112 of the hanging rod 102 and the coating 112 of the hanging rod 104 cover the second end 108, the extension 502, the notch 110, and a portion of the respective hanging rod 102, 104 beyond the notch 110. In the illustrated example, the coating 112 does not cover the dimples 124, 126 of the hanging rods 102, 104.

As illustrated in FIG. 7, the dimple 124 of the hanging rod 102 and the dimple 126 of the hanging rod 104 are offset from each other relative the second end 108. For example, the dimple 124 is spaced apart from the second end 108 of the hanging rod 102 by a first distance 704, and the dimple 126 is spaced apart from the second end 108 of the hanging rod 104 by a second distance 706 that is different than the first distance 704. In the illustrated example, the first distance 704 is about 0.625 inches and the second distance 706 is about 0.875 inches such that the dimples 124, 126 are offset by about 0.25 inches relative the second end 108. In other examples, other dimensions may be used.

The dimples 124, 126 are offset from each other relative the second end 108 to prevent the dimples 124, 126 and, thus, the respective hanging rods 102, 104 from nesting together when one of the rods 102, 104 is placed on top of the other of the rods 102, 104. For example, the dimple 124 of the hanging rod 102 is to engage the middle portion 118 of the hanging rod 104 to prevent the hanging rod 104 from nesting with the hanging rod 102. Likewise, the dimple 126 of the example hanging rod 104 is to engage the middle portion 118 of the hanging rod 102 to prevent the hanging rod 102 from nesting with the hanging rod 104.

Further, returning to FIGS. 1 and 2, the dimple 126 adjacent the first end 106 of the hanging rod 104 is spaced apart from the first end 106 by a distance (e.g., the second distance 706 of FIG. 7) that is greater than a distance (e.g., the first distance 704 of FIG. 7) at which the dimple 124 adjacent the first end 106 of the hanging rod 102 is spaced apart from the first end 106. The inverted staggering of the dimples 124, 126 adjacent the first and second ends 106, 108 prevents the dimples 124, 126 from nesting together and, thus, prevents the corresponding hanging rods 102, 104 from nesting together. In other words, because a distance between the dimples 124 of the hanging rod 102 is different than a distance between the dimples 126 of the hanging rod 104, the dimples 124, 126 prevent the hanging rods 102, 104 from nesting together.

Figure 8:
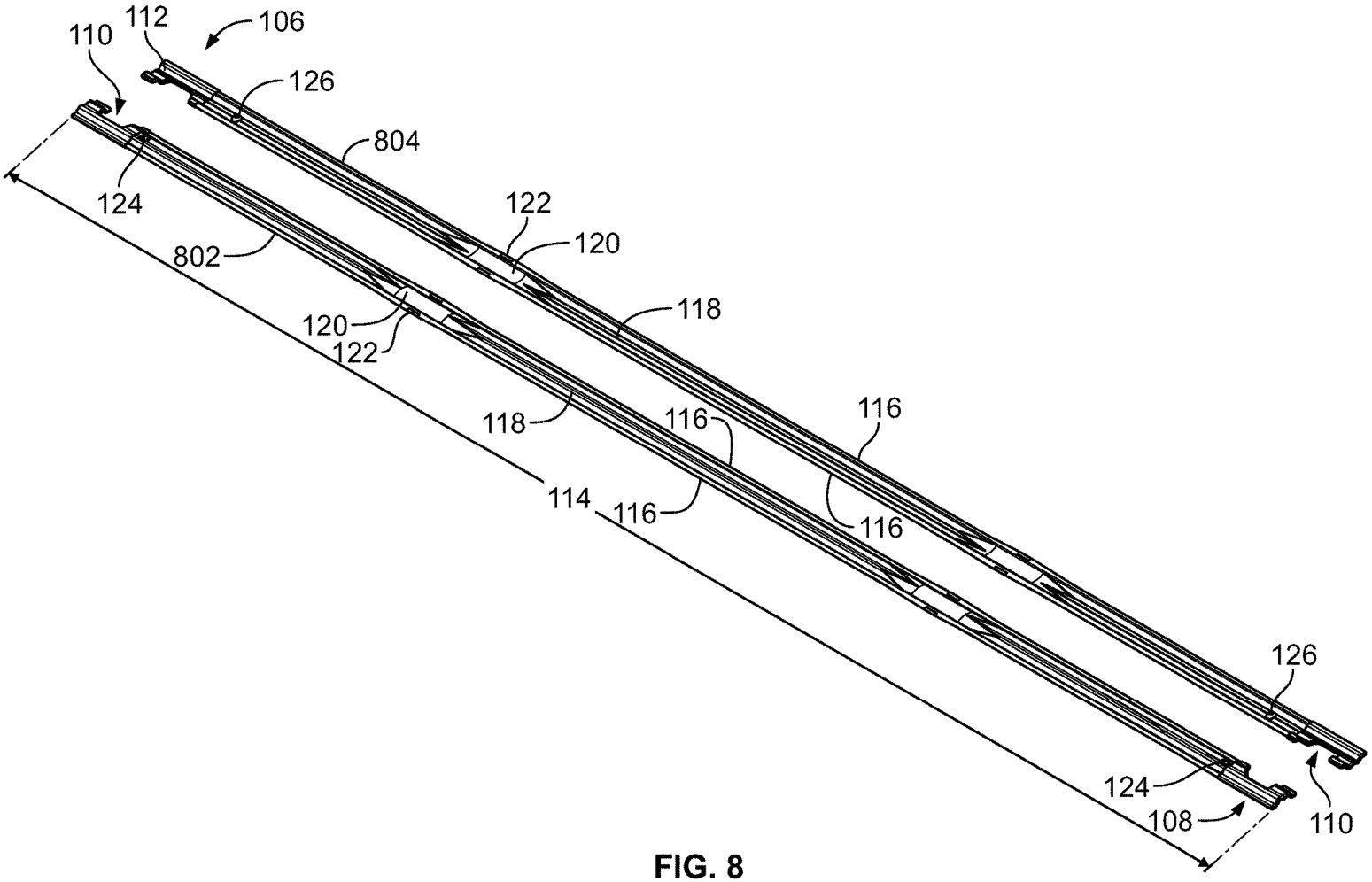
FIG. 8 is a front perspective view and a rear perspective view of other example hanging rods in accordance with the teachings of this disclosure.
Figure 9:
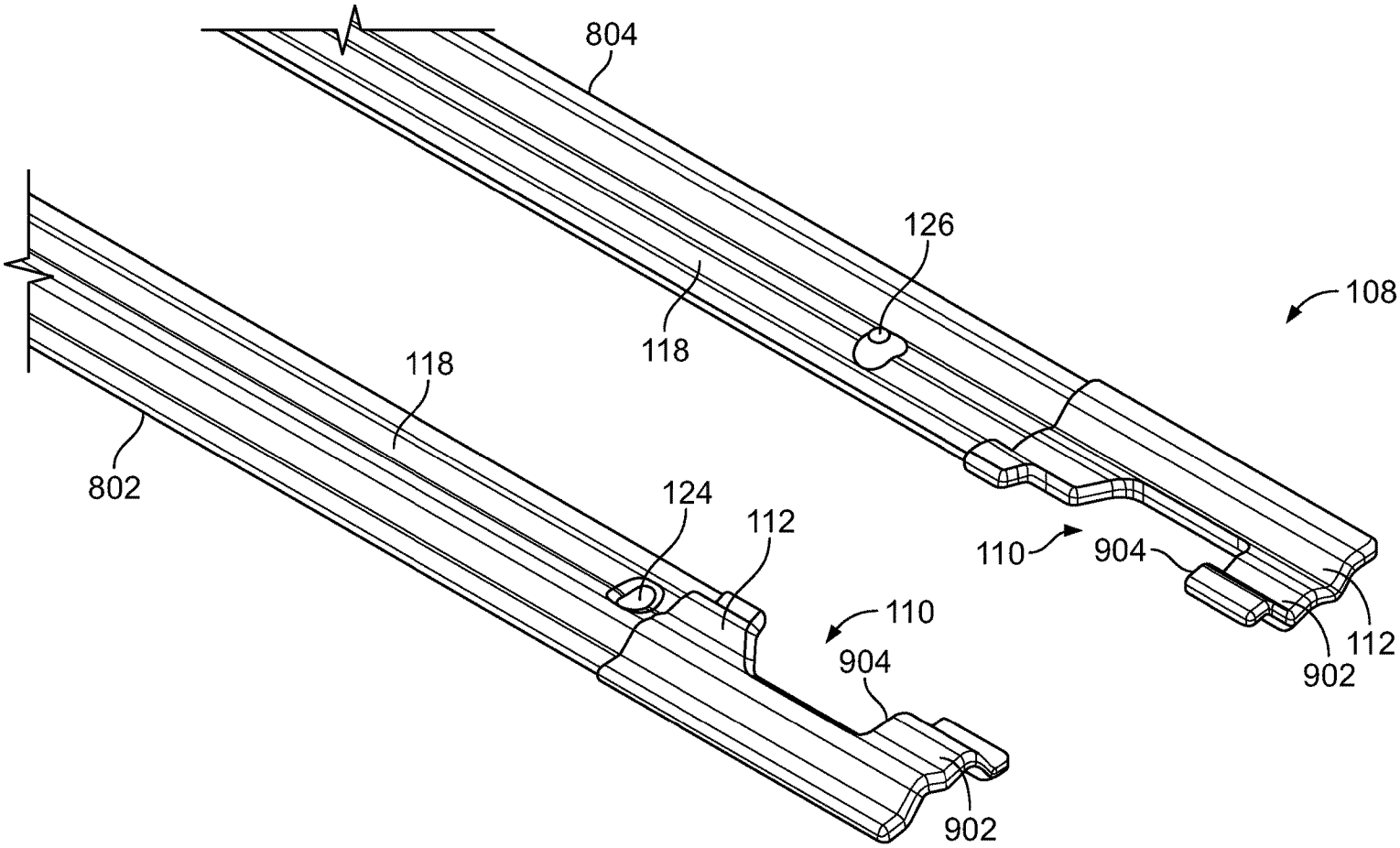
FIG. 9 is an enlarged view of one of the ends of the example hanging rods of FIG. 8.

FIG. 8 is a perspective view of other example hanging rods 802, 804 in accordance with the teachings of this disclosure and FIG. 9 is an enlarged view of one end of FIG. 8. As illustrated in FIG. 8, the example hanging rods 802, 804 include the first end 106, the second end 108, the notches 110, the coating 112, the outer flanges 116, the middle portion 118, the intermediate portion 120, the tabs 122, and the respective dimples 124, 126. The first end 106, the second end 108, the notches 110, the coating 112, the outer flanges 116, the middle portion 118, the intermediate portion 120, the tabs 122, and the respective dimples 124, 126 of FIGS. 8 and 9 are substantially similar or identical to those components having the same reference numbers in FIGS. 1-7. Those components are described above in further detail in connection with FIGS. 1-7 and will not be described in detail again. 100641 As illustrated in FIG. 8, the cross-sections of the middle portion 118 of the hanging rods 802, 804 extends between the first end 106 and the second end 108 along the length 114 of the hanging rods 802, 804. Thus, as illustrated in FIG. 9, the cross-section of the middle portion 118 of the respective hanging rods 802, 804 extends along an extension 902 protruding between the notch 110 and the adjacent second 108. For example, the hanging rod 802 is oriented in FIG. 9 such that the extension 902 of the hanging rod 802 has an M-shaped cross-section, and the hanging rod 804 is oriented in FIG. 9 such that the extension 902 of the hanging rod 804 has a W-shaped cross-section. As illustrated in FIG. 9, the extensions 902 define portions 904 of the adjacent notches 110 of the respective hanging rods 802, 804. Because the cross-sections of the middle portions 118 of the hanging rods 802, 804 extend along the extensions 902, the portions 904 of the notches 110 defined by the extensions 902 match at least a portion of the M-shaped cross-section or the W-shaped cross-section of the respective hanging rod 802, 804.

Figure 10:
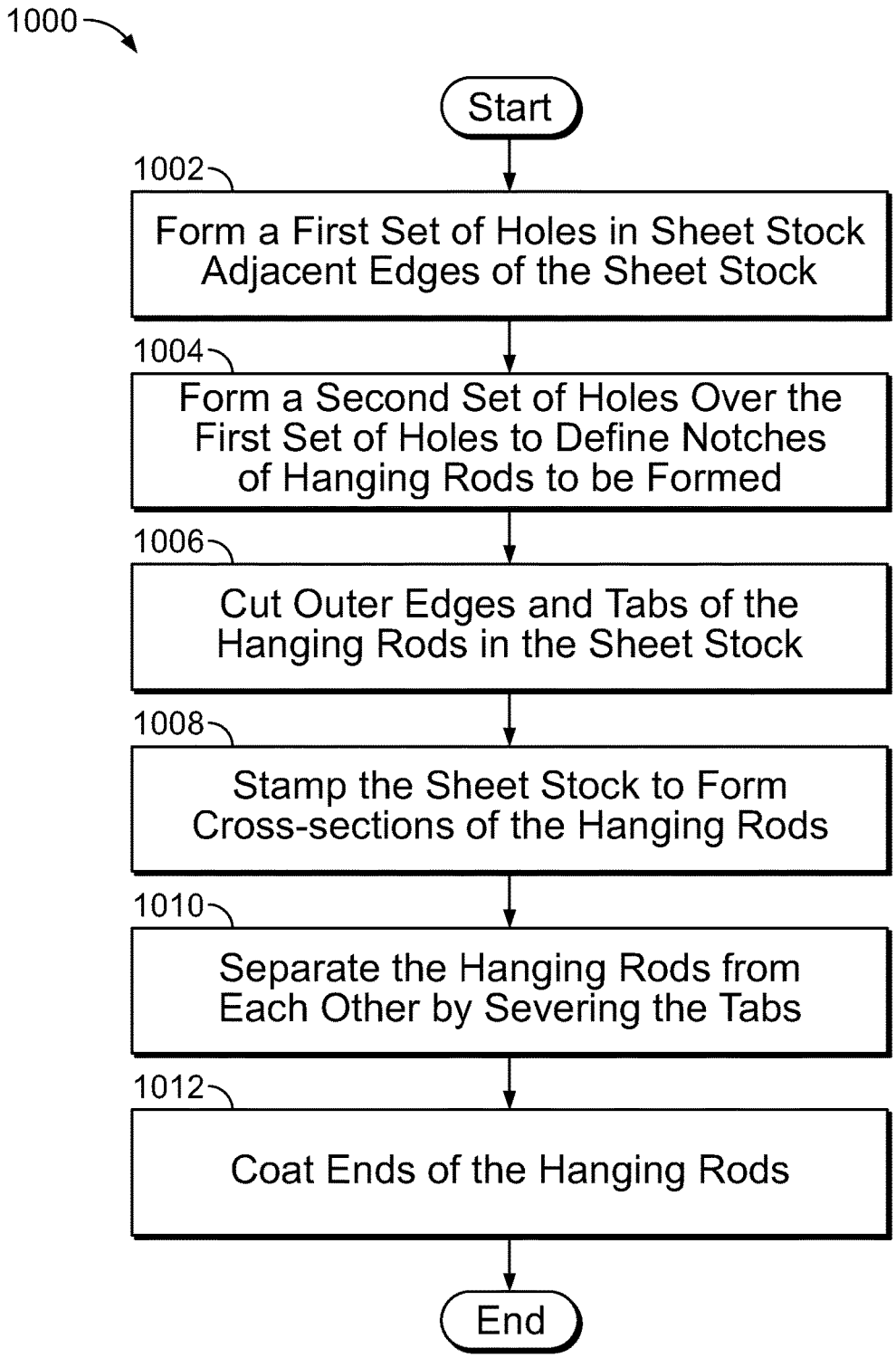
FIG. 10 is a flowchart representative of an example method to manufacture the example hanging rods of FIGS. 1-7 and/or the example hanging rods of FIGS. 8-9 in accordance with the teachings of this disclosure.

FIG. 10 is a flowchart representative of an example method 1000 to manufacture hanging rods in accordance with the teachings herein. Although the example method 1000 is described with reference to the flowchart illustrated in FIG. 10, many other methods of manufacturing the hanging rods may alternatively be used. For example, the order of execution of the blocks may be changed, and/or some of the blocks described changed, eliminated, and/or combined.

The example method 1000 for manufacturing hanging rods is discussed in connection with the example hanging rods 102, 104 of FIGS. 1-7 and the example hanging rods 802, 804 of FIGS. 8-9. Further, because the example method 1000 may refer to the example hanging rods 102, 104 of FIGS. 1-7 and/or the example hanging rods 802, 804 of FIGS. 8-9, components identified in FIGS. 1-9 having functions substantially similar or identical to the functions of components described below will not be described in detail again. Instead, the same reference numbers will be used for like structures.

The example method 1000 disclosed herein starts at block 1002 by forming a first set of holes (e.g., holes 1102 of FIG. 11) in sheet stock (e.g., sheet stock 1104 of FIG. 11) adjacent edges (e.g., edges 1106 of FIG. 11) of the sheet stock. In some examples, the first set of holes is punched in the sheet stock. At block 1004, the example method 1000 includes forming a second set of holes (e.g., holes 1108 of FIG. 11) over the first set of holes to define notches (e.g., the notches 110 of FIGS. 1-2, 5, and 7-9) of hanging rods (e.g., the hanging rods 102, 104 of FIGS. 1-7, the hanging rods 802, 804 of FIGS. 8-9) to be formed. For example, the second set of holes is punched in the sheet stock over the punched first set of holes to define the notches of the hanging rods. The second set of holes formed at block 1004 has different perimeters than perimeters of the first set of holes, and the perimeters of the second set of holes define the notches of the hanging rods.

At block 1006, the example method 1000 includes cutting outer edges (e.g., outer edges 1110 of FIG. 11) and tabs (e.g., the tabs 122 of FIGS. 1 and 8) of the hanging rods to be formed. For example, the outer edges of a first hanging rod (e.g., the hanging rod 102 of FIGS. 1-2 and 7, the hanging rod 802 of FIGS. 8-9) and an adjacent second hanging rod (e.g., the hanging rod 104 of FIGS. 1-2 and 7, the hanging rod 804 of FIGS. 8-9) are cut at block 1006. The tabs are cut to enable the adjacent hanging rods formed from the sheet stock (e.g., hanging rods 102, 104, hanging rods 802, 804) to temporarily remain integrally coupled together as part of the sheet stock. For example, at block 1006, the tabs are cut along a length (e.g., the length 114 of FIGS. 1 and 8) of the hanging rods to enable the hanging rods to remain coupled along the length of the hanging rods and, thus, reduce a width of the sheet stock used to form the hanging rods.

At block 1008, the example method 1000 includes stamping the sheet stock to form cross-sections of the hanging rods. For example, the sheet stock is stamped to form a first middle portion (e.g., the middle portion 118 of FIGS. 1-2 and 7-9) between first outer flanges (e.g., the outer flanges 116 of FIGS. 1-2 and 8) of the first hanging rod such that the first middle portion has an M-shaped or W-shaped cross-section (depending on its orientation) to increase a rigidity and/or strength of the first hanging rod and to form a second middle portion (e.g., the middle portion 118) between second outer flanges (e.g., the outer flanges 116) of the second hanging rod such that the second middle portion has an M-shaped or W-shaped cross-section (depending on its orientation) to increase a rigidity and/or strength of the second hanging rod.

In some examples, the sheet stock is stamped to concurrently form the cross-section of the first hanging rod and the cross-section of the second hanging rod. Additionally or alternatively, the sheet stock may be stamped at block 1008 to form the cross-section of the first hanging rod in a first orientation and the cross-section of the second hanging rod in a second orientation different than the first orientation. For example, the first hanging rod may be oriented to define a W-shaped cross-section, and the second hanging rod may be orientated to define an M-shaped cross-section. In some examples, the sheet stock is stamped such that the M-shaped or W-shaped cross-section of the middle portion extends along the length of the hanging rod. For example, to form the hanging rods 802, 804 of FIGS. 8 and 9, the sheet stock is stamped so that the M-shaped or W-shaped cross-section of the middle portion extends to each of the opposing ends (e.g., the first end 106, the second end 108) of the hanging rods 802, 804. Further, the sheet stock may be stamped at block 1008 to form a first intermediate portion (e.g., the intermediate portion 120 of FIGS. 1-2 and 8) having an arc-shaped cross-section adjacent the first middle portion of the first hanging rod and a second intermediate portion (e.g., the intermediate portion 120) having an arc-shaped cross-section adjacent the second middle portion of the second hanging rod. In some examples, the sheet stock is stamped to form dimples in the middle portions of the hanging rods that prevent the hanging rods from nesting together. For example, the sheet stock is stamped to form a first dimple of the first hanging rod (e.g., the dimple 124 adjacent the first end 106), a second dimple of the second hanging rod (e.g., the dimple 126 adjacent the first end 106) that is offset from the first dimple, a third dimple of the first hanging rod (e.g., the dimple 124 adjacent the second end 108) and/or a fourth dimple of the second hanging rod (e.g., the dimple 126 adjacent the second end 108) that is offset from the third dimple.

At block 1010, the example method 1000 includes separating the adjacent hanging rods from each other and/or from the sheet stock by severing the tab(s) that had previously kept the adjacent hanging rods coupled together and/or to the sheet stock. At block 1012, the example method 1000 includes coating ends (e.g., the first end 106 and the second end 108 of FIGS. 1-2 and 8) of the separated hanging rods with a coating (e.g., the coating 112 of FIGS. 1-2 and 7-9). For example, the ends of the hanging rods are coated via a powder coating process, though other suitable material(s) and/or process(es) may additionally or alternatively be used.

Figure 11:
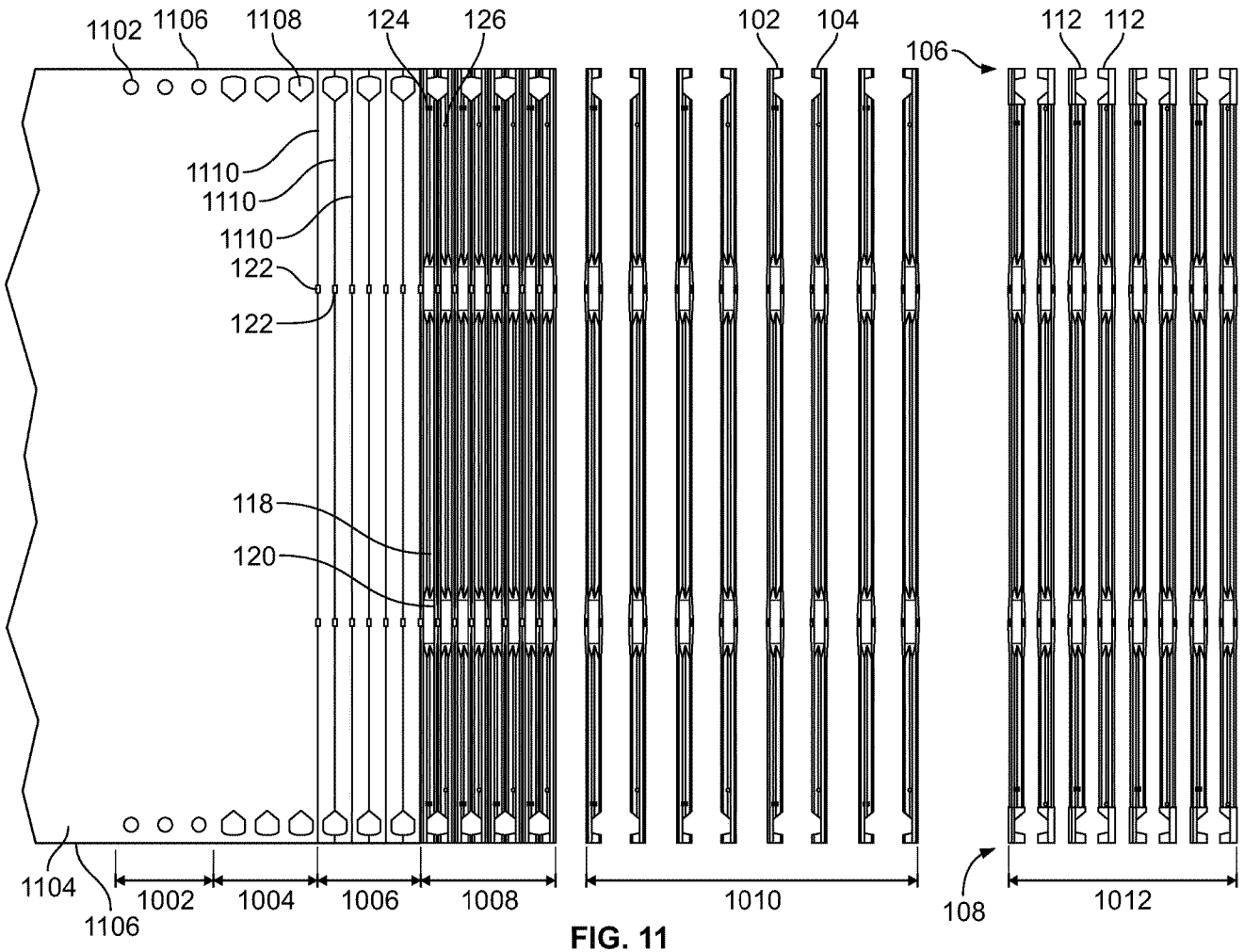
FIG. 11 illustrates an example progression of FIG. 10 to produce the example hanging rods of FIGS. 1-7 from sheet stock.

As discussed above, FIG. 11 illustrates the steps of the method to manufacture 1000 of FIG. 10 that are executed to produce the example hanging rods 102, 104 from the sheet stock 1102. For example, FIG. 11 depicts the holes 1102 that are formed adjacent the edges 1106 of the sheet stock 1104 at block 1002, the second set of holes 1108 that is formed over the holes 1102 at block 1004, and the outer edges 1110 and the tabs 120 that are cut at block 1006. The illustrated example includes the middle portion 118, the intermediate portion 120, and the dimples 124, 126 that are formed in the hanging rods 102, 104 at block 1008 of the example method 1000 of FIG. 10. Further, FIG. 11 depicts the hanging rods 102, 104 that are separated from each other and/or the sheet stock at block 1010 and the coating 112 that is applied to the ends 106, 108 of the hanging rods 102, 104 at block 1012.

Although certain example apparatus have been described herein, the scope of coverage of this patent is not limited thereto. On the contrary, this patent covers all methods, apparatus and articles of manufacture fairly falling within the scope of the amended claims either literally or under doctrine of equivalents.

What is claimed is:

1. A hanging rod to hang a file folder, the hanging rod comprising:

a first end;

a second end opposite the first end;

a first outer flange and a second outer flange extending between the first end and the second end;

a middle portion between the first and second outer flanges, the middle portion having a first peak and a second peak forming an M-shaped cross-section to increase a rigidity of the hanging rod; and a first notch adjacent the first end and a second notch adjacent the second end that enable the hanging rod to hang from a support structure, the first outer flange and the first peak of the middle portion interrupted by the first notch.

2. The apparatus of claim 1, wherein a nadir of the M-shaped cross-section of the middle portion is spaced apart from a plane along which the outer flanges extend.

3. The apparatus of claim 1, further including an intermediate portion between the outer flanges and adjacent the middle portion, the intermediate portion having an arc-shaped cross-section.

4. The apparatus of claim 3, wherein the intermediate portion and the outer flanges define a first width of the hanging rod that is greater than a second width of the hanging rod defined by the middle portion and the outer flanges.

5. The apparatus of claim 3, wherein the middle portion and the intermediate portion alternate along a length of the hanging rod between the first end and the second end.

6. The apparatus of claim 1, wherein the middle portion defines a first dimple to prevent the hanging rod from nesting with a second hanging rod.

7. The apparatus of claim 6, wherein the first dimple extends beyond the M-shaped cross-section of the middle portion and to a plane along which the outer flanges extend.

8. The apparatus of claim 6, wherein the first dimple is offset relative a second dimple of the second hanging rod to further prevent the hanging rod from nesting with the second hanging rod.

9. The apparatus of claim 6, wherein the middle portion of the hanging rod defines a third dimple spaced apart from the first dimple, the third dimple being offset relative a fourth dimple of the second hanging rod to further prevent the hanging rod from nesting with the second hanging rod.

10. The apparatus of claim 1, further including:

a first extension having a flat surface and protruding between the first notch and the first end, the first extension defining a portion of the first notch; and a second extension having a flat surface and protruding between the second notch and the second end, the second extension defining a portion of the second notch.

11. The apparatus of claim 1, further including:

a first extension protruding between the first end and the first notch, the middle portion of the hanging rod extending along the first extension such that the M-shaped cross-section defines a portion of the first notch; and a second extension protruding between the second end and the second notch, the middle portion extending along the second extension such that the M-shaped cross-section defines a portion of the second notch.

12. The apparatus of claim 1, further including a coating adjacent the first end and the second end to enable the hanging rod to slide along the support structure.

13. The apparatus of claim 1, wherein the first outer flange and the first peak of the middle portion are interrupted by the second notch.

14. The apparatus of claim 1, wherein the second outer flange and the second peak of the middle portion extend over the first notch.

15. The apparatus of claim 1, wherein the second outer flange and the second peak of the middle portion extend over the second notch.

16. The apparatus of claim 1, wherein the first flange and the first peak of the middle portion form a first boundary of the first notch, and wherein a first extension forms a second boundary of the first notch.

17. The apparatus of claim 1, wherein the first flange and the first peak of the middle portion form a first boundary of the second notch, and wherein a second extension forms a second boundary of the second notch.

* * * * *